US006576339B1

(12) United States Patent
Cordes et al.

(10) Patent No.: US 6,576,339 B1
(45) Date of Patent: Jun. 10, 2003

(54) POLYESTER-STAPLE FIBRES AND METHOD FOR THE PRODUCTION THEREOF

(75) Inventors: Ingo Cordes, Maintal (DE); Dietmar Wandel, Hanau (DE); Helmut Schwind, Hanau (DE); Wolfgang Janas, Geiselbach (DE); Werner Ude, Darmstadt (DE)

(73) Assignee: Lurgi Zimmer AG, Frankfurt am Main (DE)

( * ) Notice: Subject to any disclaimer, the term of this patent is extended or adjusted under 35 U.S.C. 154(b) by 0 days.

(21) Appl. No.: 10/049,013

(22) PCT Filed: Jul. 25, 2000

(86) PCT No.: PCT/EP00/07087

§ 371 (c)(1),
(2), (4) Date: Jun. 24, 2002

(87) PCT Pub. No.: WO01/11117

PCT Pub. Date: Feb. 15, 2001

(30) Foreign Application Priority Data

Aug. 10, 1999 (DE) ..... 199 37 727

(51) Int. Cl.[7] ..... D01F 6/00
(52) U.S. Cl. ..... 428/364; 428/395
(58) Field of Search ..... 428/364, 395; 264/103, 210.5, 210.8

(56) References Cited

U.S. PATENT DOCUMENTS

| | | | | |
|---|---|---|---|---|
| 5,962,131 | A | 10/1999 | Schwind et al. | 428/364 |
| 5,993,712 | A | 11/1999 | Wandel et al. | 264/103 |

FOREIGN PATENT DOCUMENTS

| | | | |
|---|---|---|---|
| EP | 0 860 524 | A | 8/1998 |
| GB | 1254826 | A | 11/1971 |
| JP | 57061720 | | 4/1982 |
| WO | WO 99 07927 | A | 2/1999 |

*Primary Examiner*—N. Edwards
(74) *Attorney, Agent, or Firm*—Norris McLaughlin & Marcus

(57) ABSTRACT

Polyester staple fibres consisting of a polyester, from 0.1 to 2.0% by weight of an incompatible, thermoplastic, amorphous, polymeric additive having a glass transition temperature of from 90 to 170° C. and a ratio of its melt viscosity to that of the polyester component of from 1:1 to 10:1, and from 0 to 5.0% by weight of conventional additives, where the polymeric additive is present in the staple fibres in the form of fibrils having a mean diameter of ≦80 nm.

Process for the production of these staple fibres by mixing with shearing of the polyester and of the polymeric additive and, optionally, of the conventional additives, spinning at a spinning take-off speed of <2500 m/min to give spun filaments, which are combined to form tows and stretched in a separate fibre stretching stage, crimped, dried and chopped to give staple fibres.

17 Claims, No Drawings

POLYESTER-STAPLE FIBRES AND METHOD FOR THE PRODUCTION THEREOF

This is a 371 of PCT/EP00/07087, filed Jul. 25, 2002 (International Filing Date).

DESCRIPTION

The invention relates to polyester staple fibres and to a process for the production of these staple fibres.

Staple fibres made from polyethylene terephthalate and processes for their production have been known for some time (F. Fourné. Syntheti-sche Fasern [Synthetic Fibres], Hanser Verlag. Munich [1995] 91–94 and 462–486).

Besides the quality of the staple fibres, the spin factor SF, i.e. the throughput (g/min) per spinneret field area ($cm^2$), is of importance here, where $$SF=HD\cdot d\cdot DR\cdot v\cdot 10^{-4}\cdot K$$

and

HD denotes the hole density ($n/cm^2$)=number of spinneret holes per spinneret field area, d denotes the titre of the staple fibres (dtex), $d_0$ denotes the titre of the spun filaments (dtex), DR denotes the overall stretching ratio=1: . . . , v denotes the spinning take-off speed (m/min), K denotes a polyester-dependent constant, where $$K=\frac{d}{d_0\cdot DR}=\frac{100-relaxation\ (\%)}{100},$$

for example about 0.92 for PET and about 0.73 for PTT.

The aim is the highest possible spin factor, preferably in the range from 2.9 to 10.0.

The hole density HD is determined by the available spinning machine and cannot be increased as desired, even for geometrical reasons. The spinning take-off speed is restricted to speeds below 2500 m/min by the tow baling system of the spun filaments and their further conversion into staple fibres. The stretching ratio is, to a first approximation, proportional to the elongation at break of the spun filament, the elongation at break for a specific polymer being lower the higher the spinning take-off speed. Low titres, in particular microfilaments of <1 dpf, or intensive cooling also reduce the elongation at break and thus the stretching ratio and the spin factor: reductions in capacity are the consequence. For a specified spinning take-off speed, the spin factor can consequently be increased by selecting a polymer of higher elongation at break. On the other hand, the polymer determines the quality of the staple fibres and therefore can only be changed minimally or not at all.

WO 99/07927 Al discloses that the elongation at break of pre-orientated polyester yarns (POYs) which have been spun at take-off speeds of at least 2500 m/min, preferably from 3000 to 6000 m/min, can be increased by the addition of amorphous, thermoplastic copolymers based on styrene, acrylic acid and/or maleic acid or derivatives thereof compared with the elongation at break of polyester filaments spun under identical conditions without addition. However, the process cannot be applied to spun filaments produced at take-off speeds of below 2500 m/min since these, in contrast to POY fibres, are of low crystallinity (<12%) and have high shrinkage on boiling (>40%) and high elongation at break (>225%).

In EP 0 080 274 B and EP 0 154 425 B, the same effect is achieved by addition of polyolefins or PA-66 to polyethylene terephthalate. According to EP 0 080 274 B, the effect increases with increasing spinning take-off speed, where the wind-up speed must be at least 2000 m/min. According to EP 0 154 425 B, the effect can also be achieved, albeit to a lesser extent, at lower wind-up speeds if the polyethylene terephthalate has an intrinsic viscosity of greater than 0.70 dl/g.

EP 0 631 638 B describes filaments made from polyethylene terephthalate containing imidated poly(alkyl methacrylates) which have subsequently been subjected to final stretching. Although the industrial yarn spun at 510 m/min has increased elongation at break, the stretching is, however, not improved, and the yarn otherwise has worse properties than filaments without additive.

It is furthermore known that it is possible to spin polypropylene terephthalate (EP 745 711 A, WO 96/00808 A) and polybutylene terephthalate (U.S. Pat. No. 4,877,572) to give continuous filaments. However, no mention is made of their suitability for the production of staple fibres.

The object of the present invention is to maximize the spin factor in the production of polyester staple fibres, where the staple fibres must have the same or better quality values than staple fibres produced by known processes.

This object is achieved in accordance with the invention by polyester staple fibres and by a process for their production as described in the patent claims.

The term polyester here is taken to mean poly($C_{2-4}$-alkylene) tere-phthalates, which may comprise up to 15 mol % of other dicarboxylic acids and/or diols, such as, for example, isophthalic acid, adipic acid, diethylene glycol, polyethylene glycol, 1,4-cyclohexanedimethanol, or the respective other $C_{2-4}$-alkylene glycols. Preference is given to polyethylene terephthalate having an intrinsic viscosity (I.V.) in the range from 0.5 to 0.7 dl/g, polypropylene terephthalate having an I.V. of from 0.6 to 1.2 dl/g and polybutylene terephthalate having an I.V. of from 0.6 to 1.2 dl/g. Conventional additives, such as dyes, matting agents, stabilizers, antistatics, lubricants and branching agents, may be added to the polyester or polyester/additive mixture in amounts of from 0 to 5.0% by weight without any disadvantage.

In accordance with the invention, a copolymer is added to the polyester in an amount of from 0.1 to 2.0% by weight, where the copolymer must be amorphous and substantially insoluble in the polyester matrix. The two polymers are essentially incompatible with one another and form two phases which can be differentiated microscopically. Furthermore, the copolymer must have a glass transition temperature (determined by DSC at a heating rate of 10° C./min) of from 90 to 170° C. and must be thermoplastic.

The melt viscosity of the copolymer should be selected here so that the ratio of its melt viscosity extrapolated to the measurement time zero, measured at an oscillation rate of 2.4 Hz and a temperature which is equal to the melting point of the polyester plus 34.0° C. (290° C. for polyethylene terephthalate) relative to that of the polyester, measured under the same conditions, is between 1:1 and 10:1, i.e. the melt viscosity of the copolymer is at least equal to or preferably greater than that of the polyester. The optimum effectiveness is only achieved through the choice of a specific viscosity ratio of additive to polyester. At a viscosity ratio optimised in this way, it is possible to minimize the amount of additive added, making the economic efficiency of the process particularly high and meaning that particularly favourable processing properties are achieved. Surprisingly, the viscosity ratio determined as ideal in accordance with the invention for the use of polymer mixtures for the production of staple fibres is above the range indicated as favourable in the literature for the mixing of two polymers. In contrast to the prior art, polymer mixtures with high-molecular-weight copolymers were highly suitable for spinning. Surprisingly, it has been found that the melt viscosity of the mixture does not increase significantly under the conditions according to the invention. A positive result of this is avoidance of increases in the pressure drop in the melt lines.

Due to the high flow activation energy of the additive polymers, the viscosity ratio after exit of the polymer mixture from the spinneret increases dramatically in the filament formation zone. Through the choice of a favourable viscosity ratio, a particularly narrow particle size distribution of the additive in the polyester matrix is achieved, and by combining the viscosity ratio with a flow activation energy which is significantly greater than that of the polyester (PET about 60 kJ/mol), i.e. greater than 80 kJ/mol, a fibril structure of the additive is obtained in the spun filament. The high glass transition temperature compared with the polyester ensures rapid solidification of this fibril structure in the spun filament. The maximum particle sizes of the additive polymer here immediately after exiting from the spinneret are about 1000 nm, while the mean particle size is 400 nm or less. After drawing beneath the spinneret, fibrils having a mean diameter of ≦80 nm are formed.

The ratio between the melt viscosity of the copolymer and that of the polyester under the above-mentioned conditions is preferably between 1.5:1 and 7:1. Under these conditions, the mean particle size of the additive polymer immediately after exiting from the spinneret is 120–300 nm, and fibrils having a mean diameter of about 40 nm are formed.

The additive polymers to be added in accordance with the invention to the polyester may have a different chemical composition so long as they have the above-mentioned properties. Three different types of copolymer are preferred, namely 1. A copolymer which comprises the following monomer units A=acrylic acid. methacrylic acid or $CH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-aryl radical, B=styrene or $C_{1-3}$-alkyl-substituted styrenes, where the copolymer consists of from 60 to 98% by weight of A and from 2 to 40% by weight of B, preferably of from 83 to 98% by weight of A and from 2 to 17% by weight of B, and particularly preferably of from 90 to 98% by weight of A and from 2 to 10% by weight of B (sum=100% by weight).

2. A copolymer which comprises the following monomer units

C=styrene or $C_{1-3}$-alkyl-substituted styrenes,

D=one or more monomers of the formula I, II or III (I)

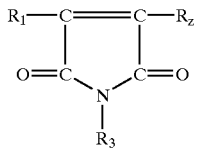

-continued (II)

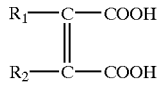

(III)

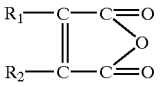

where $R_1$, $R_2$ and $R_3$ are each an H atom or a $C_{1-15}$-alkyl radical or a $C_{5-12}$-cycloalkyl radical or a $C_{6-14}$-aryl radical.

where the copolymer consists of from 15 to 95% by weight of C and from 5 to 85% by weight of D, preferably of from 50 to 90% by weight of C and from 10 to 50% by weight of D, and particularly preferably of from 70 to 85% by weight of C and from 15 to 30% by weight of D, where the sum of C and D together gives 100%.

3. A copolymer which comprises the following monomer units

E=acrylic acid, methacrylic acid or $CH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-aryl radical, F=styrene or $C_{1-3}$-alkyl-substituted styrenes, G=one or more monomers of the formula I, II or III (I)

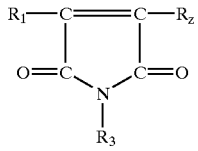

(II)

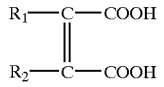

(III)

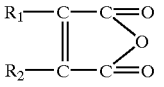

where $R_1$, $R_2$ and $R_3$ are each an H atom or a $C_{1-15}$-alkyl radical or a $C_{5-12}$-cycloalkyl radical or a $C_{6-14}$-aryl radical.

H=one or more ethylenically unsaturated monomers which can be copolymerized with E and/or with F and/or G, from the group consisting of α-methylstyrene, vinyl acetate, acrylates and methacrylates which are different from E, vinyl chloride, vinylidene chloride, halogen-substituted styrenes, vinyl esters, isopropenyl ethers and dienes, where the copolymer consists of from 30 to 99% by weight of E, from 0 to 50% by weight of F, from>0 to 50% by weight of G and from 0 to 50% by weight of H, preferably of from 45 to 97% by weight of E, from 0 to 30% by weight of F, from 3 to 40% by weight of G and from 0 to 30% by weight of H, and particularly preferably of from 60 to 94% by weight of E, from 0 to 20% by weight of F, from 6 to 30% by weight of G and from 0 to 20% by weight of H, where the sum of E, F, G and H together gives 100%.

Component H is an optional component. Although the advantages to be achieved in accordance with the invention can be achieved merely by means of copolymers which have components from groups E to G, the advantages to be achieved in accordance with the invention also arise if further monomers from group H are involved in the build-up of the copolymer to be employed in accordance with the invention.

Component H is preferably selected in such a way that it does not have an adverse effect on the properties of the copolymer to be used in accordance with the invention. Component H can therefore be employed, inter alia, in order to modify the properties of the copolymer in the desired manner, for example by increasing or improving the flow properties when the copolymer is heated to the melting point, or for reducing a residual colour in the copolymer or through the use of a polyfunctional monomer in order in this way to introduce a certain degree of crosslinking into the copolymer.

In addition, H may also be selected in such a way that copolymerization of components E to G only becomes possible at all or is supported, as in the case of MSA and MMA, which do not copolymerise per se, but copolymerise without difficulty on addition of a third component, such as styrene. The monomers which are suitable for this purpose include, inter alia, vinyl esters, esters of acrylic acid, for example methyl and ethyl acrylate, esters of methacrylic acid other than methyl methacrylate, for example butyl methacrylate and ethylhexyl methacrylate, vinyl chloride, vinylidene chloride, styrene, α-methylstyrene and the various halogen-substituted styrenes, vinyl and isopropenyl ethers, and dienes, such as, for example, 1,3-butadiene and divinylbenzene. The reduction in colour of the copolymer can, for example, particularly preferably be achieved by use of an electron-rich monomer, such as, for example, a vinyl ether, vinyl acetate, styrene or α-methylstyrene. Of the compounds of component H, particular preference is given to aromatic vinyl monomers, such as, for example, styrene or α-methylstyrene.

The preparation of the copolymers to be used in accordance with the invention is known per se. They can be prepared by mass, solution, suspension or emulsion polymerisation. Helpful information on mass polymerisation is given in Houben-Weyl, Volume E20, Part 2 (1987), pages 1145 ff. Information on solution polymerisation is likewise given therein on pages 1149 ff., while emulsion polymerisation is likewise mentioned and explained therein on pages 1150 ff.

For the purposes of the invention, particular preference is given to bead polymers whose particle size is in a particularly favourable range. The copolymers to be used in accordance with the invention by, for example, mixing into the melt of the fibre polymers are preferably in the form of particles having a mean diameter of from 0.1 to 1.0 mm. However, larger or smaller beads or granules can also be employed, although smaller beads make particular demands on logistics, such as conveying and drying.

The imidated copolymer types 2 and 3 can be prepared either from the monomers using a monomeric imide or by subsequent complete or preferably partial imidation of a copolymer containing the corresponding maleic acid derivative. These additive polymers are obtained, for example, by complete or preferably partial reaction of the corresponding copolymer in the melt phase with ammonia or a primary alkylamine or arylamine, for example aniline (Encyclopedia of Polymer Science and Engineering, Vol. 16 [1989], Wiley-Verlag, page 78). All the copolymers according to the invention and, if indicated, their non-imidated starting copolymers are commercially available or can be prepared by a process which is familiar to the person skilled in the art.

The amount of copolymer to be added to the polyester is from 0.1 to 2.0% by weight, with added amounts of less than 1.0% usually being sufficient.

The additive concentration C in % by weight in the range from 0.1 to 2.0% by weight is particularly preferably selected for staple fibres having a titre of from 0.5 to 4.0 dtex which have been spun at a spinning take-off speed in the range from 900 to 2200 m/min in such a way that $$C = \frac{R_d - R_{do}}{b}$$

where $R_{d0}$ is the elongation at break in % of the spun filament without addition of an additive and $R_{d0}<R_d$, and b=80 to 160, preferably b=115 to 152. $R_d$, the desired elongation at break of the spun filament with addition of an additive, is >370% here if $R_{d0}$ is ≦354%.

Surprisingly, it has been found that the additive properties according to the invention that have been described and the associated specific fibril structure in the spun filament result in high efficiency, i.e. the amount of additive to be used is particularly small compared with the prior art, based on the desired effect. The desired effect can be adjusted within broad limits. This behaviour is surprising since low spin orientation, virtually no crystallization and high shrinkage on boiling and elongation values generally restrict the possibility of achieving economical or qualitative effects by means of polymer mixtures in the production of spun filaments for the production of staple fibres. Increases in elongation can thus often be achieved in the spun filament, but inadequate increases in the stretching ratio are achieved on stretching in the fibre stretching stage, and the effect on the spin factor remains insignificant.

In order to determine the spin factor, knowledge of the stretching ratio is necessary. There is no general rule, since the stretching ratio is also dependent, besides on the spun filament structure, characterized by the elongation at break (EB) of the spun filament, on the desired parameters of the end product. Nevertheless, a correlation can be approximated in the form $$DR = 1 + a \cdot \frac{EB\ (\%)}{100}$$

a where a is selected=from 0.48 to 0.96 and preferably a =0.58–0.72 (in contrast to the prior art, a is typically <1 for the staple fibre production according to the invention).

Within this range, a is selected in accordance with the desired staple fibre quality, where a low DR gives staple fibres of high extensibility, and a high DR gives staple fibres of low extensibility with otherwise the same elongation at break EB of the spun filament.

After the production of spun filaments and testing of the elongation at break, the associated stretching ratio without addition of an additive can be derived from this formula with $DR=DR_0$, and the SF can be determined. If additive is now metered in at a concentration C=0.1–2.0%, the stretching ratio increases in accordance with the invention to $$DR = DR_o + \frac{z \cdot C}{100}\ (\%).$$

A desired $DR>DR_0$ can be set by addition of additive in the range 0.1–2.0% by weight at a concentration $$C = \frac{(DR - DR_o)}{z} \cdot 100\ \%,$$

where $DR \geqq DR_0 + 0.153$.

z here is between 39 and 153, i.e. for a desired increase in the stretching ratio $DR-DR_0$, the concentration C in % is set in the range $$\frac{DR - DR_o}{153} \cdot 100 \leq C \leq \frac{DR - DR_o}{39} \cdot 100.$$

An increase in the stretching ratio of $(DR-DR_0)=0.20$ can thus be set by addition of additive corresponding to C=from 0.14 to 0.51% and an increase $(DR-DR_0)=0.45$ by addition of additive corresponding to C=from 0.30 to 1.15%. z is preferably selected between 66 and 146, and an increase in the stretching ratio of $(DR-DR_0) \geqq 0.45$ is achieved.

The invention enables a reduction in the stretching ratio occurring on variation of at least one of the parameters influencing the spin factor to be compensated by addition of the additive in such a way that SF remains at least constant.

Thus, with the polymer throughput in the spinning system set at a constant and thus with a constant SF, the hole density HD can be increased, which results in a lower DR, with the consequence that a desired low titre, in particular microtitre, can no longer be produced. The addition of additive increases the DR, and smaller titres can be produced with the same SF. If the titre or the spinning speed is changed with a constant hole density, lower DRs can be compensated by the additive, and SF and correspondingly the throughput through the spinning system can be increased proportionately.

The mixing of the additive polymer (copolymer) with the matrix polymer is carried out by addition in the form of a solid to the matrix polymer chips in the extruder feed with chip mixer or gravimetric metering or alternatively by melting the additive polymer, metering by means of a gear pump and feeding into the melt stream of the matrix polymer. So-called masterbatch methods are also possible, where the additive is in the form of a concentrate in polyester chips, which are later added in the solid or molten state to the matrix polyester. Addition to a part-stream of the matrix polymer, which is then admixed with the main stream of the matrix polymer, is also practicable.

A homogeneous distribution is subsequently produced by mixing by means of static mixers. A defined particle distribution is advantageously established through a specific choice of the mixer and the duration of the mixing process before the melt mixture is fed on through product distribution lines to the individual spinning positions and spinnerets. Mixers having a shear rate of from 12 to 128 $sec^{-1}$ have proven successful. The product of the shear rate ($s^{-1}$) and the residence time (in sec) to the power 0.8 here should be at least 250, preferably from 350 to 1250. Values above 2500 are generally avoided in order to limit the pressure drop in the pipelines.

The shear rate here is defined by the empty pipe shear rate ($sec^{-1}$) times the mixer factor, where the mixer factor is a characteristic parameter of the mixer type. For Sulzer SMX models, for example, this factor is about 3.5–4. The shear rate $\gamma$ in the empty pipe is calculated from $$\gamma = \frac{4 \cdot 10^3 \cdot F}{\pi \cdot \delta \cdot R^3 \cdot 60} \quad [s^{-1}]$$

and the residence time t (s) is calculated from $$t = \frac{V_2 \cdot \varepsilon \cdot \delta \cdot 60}{F}$$

where

F=polymer transport rate (g/min)

$V_2$=internal volume of the empty pipe ($cm^3$)

R=empty pipe radius (mm)

$\epsilon$=empty volume proportion (from 0.91 to 0.94 in the case of Sulzer SMXL models)

$\delta$=nominal density of the polymer mixture in the melt (about 1.2 $g/cm^3$).

Both the mixing of the two polymers and the subsequent spinning of the polymer mixture are carried out at temperatures, depending on the matrix polymer, in the range from 220 to 320° C., preferably at (melting point of the matrix polymer+34)±15° C. For PET, temperatures of from 275 to 305° C. are preferably set.

The production of the staple fibres and the preceding spun filaments from the polymer mixtures according to the invention by spinning at take-off speeds of <2500 m/min, preferably from 900 to 2200 m/min, is carried out using spinning apparatuses known per se. The filter pack here is fitted with filter devices and/or loose filter media in accordance with the known prior art.

After shear and filtration treatment in the spinneret pack, the molten polymer mixture is pressed through the holes of the spinneret plate. In the subsequent cooling zone, the melt filaments are cooled to below their solidification point by means of cooling air, so preventing sticking or bunching at the subsequent filament guide element. The cooling air can be supplied from an air-conditioning system by transverse or radial blowing or taken from the environment by self-suction by means of a cooling pipe. After cooling, the spun filaments are treated with spinning oil (water/oil mixture), collected to give tows over filament guide elements, taken off at a defined spinning take-off speed by means of a godet roll system and deposited in cans by means of a baling system (for example reel).

It is typical of polyester staple fibres that they are produced in large direct melt spinning machines in which the melt is distributed over the individual spinning lines and over the individual spinning systems within the lines via long heated product lines. A spinning line here is a lining up of at least one row of spinning systems whose filaments are combined in a tow baling system and deposited, and a spinning system represents the smallest spinning unit with a spinning head which contains a spinneret pack including spinneret plates.

The melt in such systems is subjected to a high thermal load at residence times of up to 35 minutes. As a consequence of the high thermal stability of the additive, the effectiveness of the polymer additive according to the invention does not result in any significant restriction of the increase in extensibility in the spun filament, and consequently a small added amount of the additive of ≦2% and in many cases≦1% is sufficient in spite of a high thermal load. Under the said conditions, a homogeneous polymer mixture is formed which is, surprisingly, characterized by a finely disperse additive distribution having a mean particle size of at most 400 nm and thus facilitates good stretchability.

The polyester/additive mixture according to the invention preferably allows the setting of an equally high throughput per time unit at the spinning pump if lower fibre titres are to be produced, relative to the possible throughput in the case of spinning without a polymeric additive. The throughput or speed of the spinning pump is preferably set higher by the factor f $$f = \frac{HD_1 \cdot \left(\frac{z \cdot C}{100} + DR_1\right) \cdot v_1}{HD_0 \cdot DR_0 \cdot v_0}$$

than in the case of spinning without an additive. HD here is the hole density (n/cm$^2$) of the spinneret plate, z is a constant in the range from 39 to 153, preferably 66 or 146, C is the concentration of the polymeric additive in % by weight, DR is the overall stretching ratio, and v is the spinning take-off speed in m/min, where the indices 1 and 0 relate to the spinning of the matrix polymer without additive polymer at the take-off speeds $v_1$ and $v_0$ respectively.

An improvement in the stretchability. characterized by a higher stretching ratio, is achieved in accordance with the invention. In particular, a suitable choice of the additive concentration C enables the overall stretching ratio DR to be adjusted by at least 0.45 units, in particular to values of ≧2.9, and particularly preferably to ≧3.5.

The ratio of the exit speed to the entry speed in the subsequent fibre stretching stage is thereby increased, preferably to at least 2.9. For the same entry speed, a higher production speed in the fibre stretching stage is thus possible.

It has also been found that the addition of an additive reduces the shrinkage on boiling of the spun filament. This is surprising inasmuch as an increase in the shrinkage on boiling value occurs in the production of POY yarn with modifier. The explanation consists in the lack of crystallization-influencing effects by the modifier. Thus, although an increase in extensibility of the spun filament occurs as in POY yarn, and the overall orientation is reduced, this reduction is, however, achieved entirely in the amorphous regions in the production of staple fibres. This special behaviour is particularly advantageous for the subsequent stretching in the fibre stretching stage. It is surprising here that high effectiveness is achieved in the amorphous structural region at low spinning speeds.

The tows deposited in the cans are subsequently converted further into staple fibres in a separate fibre stretching stage. The operating parameters of the fibre stretching stage correspond to the prior art, with the exception of the significantly higher overall stretching ratio in accordance with the invention. In detail, the fibre stretching stage comprises the following steps:

- stretching in at least one step at a temperature between 20 and 120° C. where the overall stretching ratio DR is at least 2.5,
- optionally heat-setting at a residence time of at least 3 seconds in a temperature range between 80 and 225° C. with subsequent cooling,
- crimping in a compression crimping chamber, where the tows can be exposed to a steam atmosphere either just before or during crimping,
- drying at a temperature in the range between 40 and 190° C., and
- chopping of the tow to give staple fibres having a mean length of between 6 and 220 mm, or deposition of the tow in cans followed by comminution to give staple fibres, where the production speed in the fibre stretching stage is between 100 and 500 m/min.

The properties of the additive polymer and the mixing technique have the effect that the additive polymer forms spheroidal or elongated particles in the matrix polymer immediately after exit of the polymer mixture from the spinneret. The best conditions arose when the mean particle size (arithmetic mean) $d_{50}$ was≦400 nm, and the proportion of particles>1000 nm in a sample cross section was less than 1%.

The effect of the spinning draft or stretching on these particles has been determined analytically. Recent investigations of the staple fibres by the TEM (transmission electron microscopy) method have shown that a fibril-like structure exists therein. The mean diameter of the fibrils was estimated at about 40 nm, and the length/diameter ratio of the fibrils at>50. If these fibrils are not formed or if the additive particles after exiting from the spinneret are too large in diameter or if the size distribution is not uniform enough, which is the case at an inadequate viscosity ratio, the effect is lost.

Furthermore, a glass transition temperature of from 90 to 170° C. and preferably a flow activation energy of the copolymers of at least 80 kJ/mol, i.e. a higher flow activation energy than that of the polyester matrix, is necessary for the effectiveness of the additives in accordance with this invention. Under this prerequisite, it is possible for the additive fibrils to solidify before the polyester matrix and to absorb a considerable proportion of the spinning stress present. In addition, the additives preferably to be used are distinguished by high thermal stability. Thus, the losses in extensibility due to additive decomposition in the direct spinning machines, which are operated at a long residence time and/or high temperature are minimized.

The staple fibres according to the invention have at least the same quality values as staple fibres produced analogously without a polymeric additive.

The property values indicated in the following examples and in the above text were determined as follows:

Additive fibrils: thin sections prepared in a microtome were studied by transmission electron microscopy followed by evaluation by image analysis, with the diameter of the fibrils being determined, and the length being estimated from the particle diameter determined in samples immediately after the spinneret.

The intrinsic viscosity (I.V.) was determined on a solution of 0.5 g of polyester in 100 ml of a mixture of phenol and 1.2-dichlorobenzene (3:2 parts by weight) at 25° C.

In order to determine the melt viscosity (initial viscosity), the polymer was dried under reduced pressure to a water content of ≦1000 ppm (polyester≦50 ppm). The granules were subsequently introduced onto the heated measurement plate of a plate-and-cone rheometer, type UM100, Physica Meβtechnik GmbH. Stuttgart/DE, with aeration with nitrogen. The measurement cone (MK210) was positioned on the measurement plate after the sample had melted, i.e. after about 30 seconds. The measurement was started after a further heating period of 60 seconds (measurement time=0 seconds). The measurement temperature was 290° C. for polyethylene terephthalate and additive polymers which are added to polyethylene terephthalate, or was the same as the melting point of the polyester in question plus 34.0° C. The defined measurement temperature corresponds to the typical processing or spinning temperature of the respective polyester. The amount of sample was selected in such a way that the rheometer gap was completely filled. The measurement was carried out in oscillation at the frequency 2.4 Hz (corresponding to a shear rate of 15 $sec^{-1}$) and a deformation amplitude of 0.3. and the value of the complex viscosity was determined as a function of the measurement time. The initial viscosity was then converted to the measurement time zero by linear regression.

For the determination of the glass transition temperature and the melting point of the polyester, the polyester sample was firstly melted at 310° C. for 1 minute and immediately quenched to room temperature. The glass transition temperature and the melting point were subsequently determined by DSC (differential scanning calorimetry) measurement at a heating rate of 10° C./min. The pre-treatment and measurement were carried out with nitrogen aeration.

The flow activation energy (E) is a measure of the rate of change of the zero viscosity as a function of the change in the measurement temperature, where the zero viscosity is the viscosity extrapolated to the shear rate 0. The zero viscosity was measured at temperatures in the range from 240 to 280° C. using a high-pressure capillary rheometer, model Rheograph 2002, Göbttfert GmbH, Buchen/DE, and the evaluation was carried out by the Carreau-Winter three-parameter method. The flow activation energy was then determined from the zero viscosity by means of the Arrhenius equation as described by M. Pahl et al., Praktische Rheologie der Kunststoffe und Elastomere [Practical Rheology of Plastics and Elastomers], VDI-Verlag, Düsseldorf (1995), pages 256 ff.

The breaking properties of the spun filaments were determined using a tensile tester at a clamped length of 200 mm, a pretensioning force of 0.05 cN/dtex and a testing speed of 2000 mm/min.

The shrinkage on boiling of the spun filaments was determined on samples conditioned at room temperature and previously treated for 10 minutes in water at 95±1° C.

COMPARATIVE EXAMPLE 1

Polyethylene terephthalate (PET) having an intrinsic viscosity of 0.63 dl/g and a water content of 30 ppm was melted in an extruder at a temperature of 284° C. and fed into a product line at the same temperature.

3 SMXL mixers from Sulzer, Switzerland, were installed in the line, with the shear rate being 17.5 $s^{-1}$, and the product of the shear rate and the residence time in the mixer (mixer product) in seconds to the power 0.8 being 483 at a polymer throughput of 2240 g/min. The melt was spun in a BN 100 spinning system from Zimmer, Germany, with annular spinneret and radial cooling shaft. The hole density of the spinneret plate was selected as HD=7.5 $cm^{-2}$. The spinning beam temperature was 290° C. The melt filaments exiting from the spinneret plate were cooled by means of cooling air fed radially inward from the outside at a rate of 1400 $m^3/h$ and were brought into contact with an oiling ring at a distance of 850 mm from the spinneret plate and treated with a water/oil mixture so that very stable filament running resulted. The spinning take-off speed was 1350 m/min, and the resultant spun filament elongation was 380%.

A plurality of spinning cans were collected and fed to a fibre stretching stage. The entry speed was 32 m/min, and the stretching was carried out in two steps at 70 and 100° C. with an overall stretching ratio of 3.5. The heat setting was carried out for 7 seconds at 220° C.; the tows were subsequently cooled and passed through a compression crimping chamber; the drying was carried out at 65° C. Staple fibres having a cut length of 38 mm were produced. The titre was 1.14 dtex, the tear strength was 55 cN/tex, and the elongation at break was 19.3%. The staple fibre production speed was 112 m/min.

The spin factor achieved is 3.7.

COMPARATIVE EXAMPLE 2

By reducing the throughput to 1748 g/min, a fibre having a titre of 0.89 dtex was produced under otherwise identical spinning conditions and stretching conditions, which gives a spin factor of 2.9. This stretching ratio is per se too high for this low titre, which is evident from the poor progress of stretching and greatly reduced elongation at break. At the spinning elongation of 345% which arises, the DR would have had to have been reduced to 3.3, meaning that the target titre of 0.89 dtex would no longer have been achieved. The shrinkage on boiling of the spun filament was 54%.

COMPARATIVE EXAMPLE 3

In a further experiment at a higher speed of 1850 m/min using a stretching ratio of 2.70, the throughput was adapted in such a way that the end product obtained was again the same titre of 1.14 dtex, corresponding to a spin factor of 3.9. The DR of 2.70 arose from a spinning elongation of 270%. Although the spinning speed was increased by 37%, the SF value merely rose by about 6% owing to the degressive behaviour of the DR at an increased spinning speed. The shrinkage on boiling of the spun filament was 62%.

EXAMPLE 4a–4c

Procedure and polyethyleneterephthalate (PET) correspond to Example 1. However, a side-stream melt system consisting of an extruder, a metering pump and an injector was installed for the preparation of the polymeric mixture in accordance with the invention. The additive melt was injected directly upstream of the mixer installed on the polymer line. The additive selected was a copolymer comprising 91.2% by weight of methyl methacrylate with 8.8% by weight of styrene, which had a glass transition temperature of 119° C. and a melt viscosity ratio of 4.2:1 relative to PET.

The concentration C (% by weight) was set through a suitable choice of the speed of the metering pump, based on the polymer throughput.

The polymer throughput was 1750 g/min. The mixing conditions and the spinning corresponded to those in Comparative Example 2.

The additive concentration and the stretching ratio were set to the value indicated in the table. The throughput was raised correspondingly in order to obtain the same final titre. The SF increases with the amount of additive as shown in the table. The shrinkage on boiling of the spun filament dropped from 54 to 51%. The increase in the stretching ratio as shown in the table facilitated better stretchability. The stretching problems in Comparative Example 2 do not occur either.

EXAMPLE 5

Example 4a–4c was repeated, but the speed was increased to 1850 m/min and the additive concentration C was set at 0.9% analogously to the procedure in Comparative Example 3. The stretching ratio did not have to be changed from the 1350 m/min setting, and the degressive behaviour known of the unmodified material was not apparent.

With a constant final titre, the addition of an additive increased the SF value from SF=3.9 to 5.1, i.e. by 31%, compared with the setting at 1350 m/min from even SF=3.7 to 5.1, i.e. by 38%. The shrinkage on boiling of the spun filament dropped from 62 to 53%.

COMPARATIVE EXAMPLE 6 and EXAMPLES 7 and 8

The procedure was analogous to the above examples, but with polytrimethylene terephthalate (PTT) having an intrinsic viscosity of 0.90 dl/g as matrix polymer. The additive polymer was the same as in Examples 4a–4c, with the spinning beam temperature being 255° C. and the spinning take-off speed being 900 m/min. The stretching was carried out in two steps at 57 and 70° C. the heat setting was carried out at 90° C. and the drying was carried out at 70° C., with the production speed being 100 m/min. The other parameters are shown in the table.

For all the examples according to the invention, the mean diameter of the fibrils in the fibres was less than 80 nm.

TABLE

| | | Example No. | | | | |
|---|---|---|---|---|---|---|
| | | 1 Comp. | 2 Comp. | 3 Comp. | 4a Inv. | 4b Inv. |
| Polyester | | PET | PET | PET | PET | PET |
| Additive concentration | % | 0 | 0 | 0 | 0.4 | 0.8 |
| Mixer shear rate $\gamma_m$ | $sec^{-1}$ | 17.5 | 13.7 | 18.5 | 13.7 | 15.2 |
| Mixer residence time t | sec | 63.3 | 81.1 | 59.8 | 81.0 | 72.7 |
| $\gamma_m \cdot t^{0.8}$ | | 483.3 | 459.9 | 488.8 | 460.0 | 470.1 |
| Throughput | g/min | 2240 | 1748 | 2370 | 1750 | 1950 |
| Hole density | $1/cm^2$ | 7.5 | 7.5 | 7.5 | 7.5 | 7.5 |
| Take-off speed | m/min | 1350 | 1350 | 1850 | 1350 | 1350 |
| Titre | dtex | 1.14 | 0.89 | 1.14 | 0.89 | 0.89 |
| Elongation at break of spun filament | % | 380 | 330 | 270 | 380 | 440 |
| Stretching ratio | 1: | 3.5 | 3.5 | 2.7 | 3.5 | 3.9 |
| Constant K | | 0.918 | 0.917 | 0.919 | 0.919 | 0.919 |
| Spin factor SF | | 3.7 | 2.9 | 3.9 | 2.9 | 3.2 |

| | | Example No. | | | | |
|---|---|---|---|---|---|---|
| | | 4c Inv. | 5 Inv. | 6 Comp. | 7 Inv. | 8 Inv. |
| Polyester | | PET | PET | PTT | PTT | PTT |
| Additive concentration | % | 1.5 | 0.9 | 0 | 0.6 | 1.2 |
| Mixer shear rate $\gamma_m$ | $sec^{-1}$ | 17.5 | 24.0 | 19.5 | 19.5 | 19.5 |
| Mixer residence time t | sec | 63.3 | 46.1 | 56.7 | 56.7 | 56.7 |
| $\gamma_m \cdot t^{0.8}$ | | 483.3 | 514.9 | 494.0 | 494.0 | 494.0 |
| Throughput | g/min | 2240 | 3076 | 2500 | 2500 | 2500 |
| Hole density | $1/cm^2$ | 7.5 | 7.5 | 6.3 | 6.3 | 6.3 |
| Take-off speed | m/min | 1350 | 1850 | 900 | 900 | 900 |
| Titre | dtex | 0.89 | 1.14 | 3.0 | 2.6 | 2.3 |
| Elongation at break of spun filament | % | 540 | 380 | 320 | 390 | 460 |
| Stretching ratio | 1: | 4.5 | 3.5 | 3.16 | 3.6 | 4.1 |
| Constant K | | 0.914 | 0.920 | 0.722 | 0.738 | 0.729 |
| Spin factor SF | | 3.7 | 5.1 | 3.9 | 3.9 | 3.9 |

What is claimed is:

1. Polyester staple fibres, consisting of

α) a polyester comprising at least 85 mol % of poly($C_{2-4}$-alkylene)terephthalate.

β) from 0.1 to 2.0% by weight of an incompatible, thermoplastic, amorphous, polymeric additive having a glass transition temperature in the range from 90 to 1 70° C., and γ) from 0 to 5.0% by weight of further additives, where the sum of α), β) and γ) is equal to 100%, the ratio of the melt viscosity of the polymeric additive β) to the melt viscosity of the polyester component α) is form 1:1 to 10:1, and the polymeric additive β) is present in the staple fibres in the form of fibrils having a mean diameter of ≦80 nm which are distributed in the polyester component α).

2. Polyester staple fibres according to claim 1, wherein the ratio of the melt viscosities is form 1.5:1 to 7:1.

3. Polyester staple fibres according to claim 1 wherein the polyester additive β) is a copolymer which comprises the following monomer units:

A=acrylic acid, methacrylic acid or $CH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-alkyl radical, B=styrene or $C_{1-3}$-alkyl-substituted styrenes, where the copolymer consists of from 60 to 98% by weight of A and from 2 to 40% by weight of B.

4. Polyester staple fibres according to claim 3, wherein the copolymer consists of from 83 to 98% by weight of A and from 2 to 17% by weight of B.

5. Polyester staple fibers according to claim 3 wherein the copolymer consists of form 90 to 98% by weight of A and from 2 to 10% by weight of B.

6. Polyester staple fibres according to claim 1 wherein the polymeric additive β) is a copolymer which comprises the following monomer units:

C=styrene or $C_{1-3}$-alkyl-substituted styrenes,

D=one of more monomers of the formula I, II or III

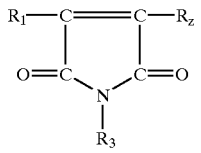

(I)

-continued (II)

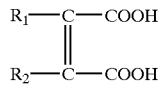

(III)

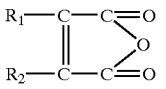

where $R_1$, $R_2$ and $R_3$ are each an H atom or a $C_{1-15}$-alkyl radical or a $C_{5-12}$-cycloalkyl radical or a $C_{6-14}$-aryl radical, and where the copolymer consists of from 15 to 95% by weight of C and from 5 to 85% by weight of D, where the sum of C and D together gives 100%.

7. Polyester staple fibres according to claim 6, wherein the copolymer consists of from 50 to 90% by weight of C and from 10 to 50% by weight of D, where the sum of C and D together gives 100%.

8. Polyester staple fibres according to claim 7, wherein the copolymer consists of from 70 to 85% by weight of C and from 15 to 30% by weight of D, where the sum of C and D together gives 100%.

9. Polyester staple fibres according to claim 1 wherein the copolymer additive β) is a copolymer which comprises the following monomer units:

E=acrylic acid, methacrylic acid or $CH_2$=CR—COOR, where R is an H atom or a $CH_3$ group, and $R^1$ is a $C_{1-15}$-alkyl radical or a $C_{5-12}$-cycloalkyl radical or a $C_{6-14}$-aryl radical.

F=styrene or $C_{1-3}$-alkly-substituted styrenes,

G=one of more monomers of the formula I, II or III (I)

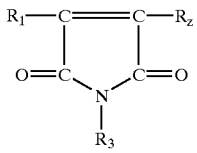

(II)

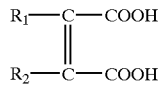

(III)

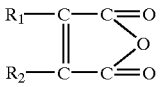

where $R_1$, $R_2$ and $R_3$ are each an H atom or a $C_{1-15}$-alkyl radical or a $C_{5-12}$-cycloalkyl radical or a $C_{6-14}$-aryl radical, H=one or more ethylenically unsaturated monomers which can be copolymerized with E and/or with F and/or g, from the group consisting of α-methylstyrene, vinyl acetate, acrylates and methacrylates which are different from E, vinyl chloride, vinylidene chloride, halogen-substituted styrenes, vinyl esters, isopropenyl ethers and dienes, where the copolymer consists of from 30 to 99% by weight of E, from 0 to 50% by weight of F, from >0 to 50% by weight of G and from 0 to 50% by weight of H, where the sum of E, F, G and H together gives 100%.

10. Polyester staple fibres according to claim 9, wherein the copolymer consists of from 45 to 97% by weight of E, from 0 to 30% by weight of F, from 3 to 40% by weight of G and from 0 to 30% by weight of H, where the sum of E, F, G and H together gives 100%.

11. Polyester staple fibres according to claim 10, wherein the copolymer consists of from 60 to 94% by weight of E, from 0 to 20% by weight of F, from 6 to 30% by weight of G and form 0 to 20% by weight of H, where the sum of E, F, G and H together gives 100%.

12. Process for the production of the polyester staple fibers of claim 1 wherein, a) a polyester α) which comprises at least 84% mol % of poly-($C_{2-4}$-alklylene)therephthalate and
   from 0.1 to 2.0% by weight of an incompatible, thermoplastic, amorphous, polymeric additive β) which has a glass transition temperature in the range from 90 to 170° C., where the ratio of the melt viscosity of the polymeric additive β) to the melt viscosity of the polyester component α) is from 1:1 to 10:1,
   and from 0 to 5.0% by weight of further additives γ), are mixed in the molten state in a static mixer with shearing, where the shear rate is from 12 to 128 $sec^{-1}$, and the product of the shear rate and the residence time in the mixer in seconds to the power 0.8 is at least 250;

b) the melt mixture from step a) is spun to give spun filaments, where the spinning take-off speed is from less than 2500 n/min;

c) the spun filaments from step b) are combined to form tows and stretched in a separate fibre stretching stage, heat-set, crimped, dried and comminuted to give staple fibres, where
   the stretching is carried out in at least one step at a temperature between 20 and 120° C. and an overall stretching ratio DR of at least 2.5,
   the heat-setting is optionally carried out at a residence time of at least 3 seconds in a temperature range between 80 and 225° C. with subsequent cooling,
   the crimping is carried out in a compression crimping chamber, where the tows can be exposed to a steam atmosphere either just before or during crimping,
   the drying is carried out at a temperature in the range between 40 and 190° C., and
   the chopping to give staple fibres having a mean length of between 6 and 220 mm, or the deposition of the tow in cans followed by comminution to give staple fibres, is carried out at a production speed in the fibre stretching stage of between 100 and 500 m/min.

13. Process for the production of polyester staple fibres according to claim 12, wherein the throughput per time unit in step b) during spinning with the take-off speed $V_1$ is set higher by the factor $$f = \frac{HD_1 \cdot \left(\frac{z \cdot C}{100} + DR_1\right) \cdot v_1}{HD_0 \cdot DR_0 \cdot v_0}$$

relative to spinning of polyester component α) without a polymeric additive βat the take-off speed $V_0$, where:

$HD_{0/1}$ is the holy density ($n/cm^2$) of the spinneret plate,

C is the concentration of the polymeric additive in % by weight, $DR_{0/1}$ is the overall stretching ratio without an additive at the respective spinning take-off speed $V_0$ or $V_1$ respectively, $V_{0/1}$ is the spinning take-off speed in m/min, and z is between 39 and 153.

14. Process for the production of polyester staple fibres according to claim 12 wherein the concentration C of the polymeric additive is in the range from 0.1 to 2.0% by weight in accordance with $$C = \frac{(DR - DR_o)}{z} \cdot 100\ (\%)$$

where DR and $DR_0$ are the stretching ratios with and without addition of an additive respectively, and $DR \geqq DR_0 + 0.153$.

15. Process for the production of polyester staple fibres according to claim 13 wherein z is between 66 and 146, and $(DR - DR_0)$ is $\geqq 0.45$.

16. Process for the production of polyester staple fibres according to claim 12, wherein the staple fibres have a titre of from 0.5 to 4.0 dtex, the spinning take-off speed is in the range from 900 to 2200 m/min, and the concentration C of the polymeric additive is in the range from 0.1 to 2.0% by weight in accordance with $$C = \frac{R_d - R_{do}}{b}$$

where b is between 80 and 160, $R_d$ is the desired elongation at break of the spun filament in %, $R_{d0}$ is the elongation at break in % of the spun filament without addition of an additive, and $R_d \geqq 370\%$ if $R_{d0} \leqq 354\%$.

17. Process for the production of polyester staple fibres according to claim 16, wherein b is between 115 and 152.

* * * * *

UNITED STATES PATENT AND TRADEMARK OFFICE

CERTIFICATE OF CORRECTION

PATENT NO. : 6,576,339 B1
DATED : June 10, 2003
INVENTOR(S) : Cordes et al.

It is certified that error appears in the above-identified patent and that said Letters Patent is hereby corrected as shown below:

Colunm 15,
Line 27, "COOR" should read -- $COOR^1$ --

Colunm 16,
Line 4, "and form" should read -- and from --
Line 57, "βat" should read -- β at --

Signed and Sealed this

Fifteenth Day of March, 2005

JON W. DUDAS
*Director of the United States Patent and Trademark Office*